US007441763B2

(12) United States Patent
Su

(10) Patent No.: US 7,441,763 B2
(45) Date of Patent: Oct. 28, 2008

(54) AUTOMATIC DOCUMENT FEEDER

(75) Inventor: Yu-Jen Su, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 257 days.

(21) Appl. No.: 11/358,407

(22) Filed: Feb. 22, 2006

(65) Prior Publication Data

US 2007/0096384 A1 May 3, 2007

(30) Foreign Application Priority Data

Oct. 28, 2005 (TW) ..... 94137959 A

(51) Int. Cl.
*B65H 5/00* (2006.01)

(52) U.S. Cl. ..... 271/10.11

(58) Field of Classification Search ..... 271/10.11
See application file for complete search history.

(56) References Cited

U.S. PATENT DOCUMENTS 5,016,866 A 5/1991 Takahashi
5,630,580 A 5/1997 Tsao et al.
5,934,664 A * 8/1999 Murayama et al. ..... 271/118
6,024,357 A 2/2000 Sheng
6,540,220 B2 4/2003 Kuo et al.
7,204,486 B2 * 4/2007 Tanabe ..... 271/272
7,210,677 B2 * 5/2007 Fukumura et al. ..... 271/10.01
7,293,769 B2 * 11/2007 Asari et al. ..... 271/258.01
7,296,790 B2 * 11/2007 Kim ..... 271/114
2001/0022422 A1 * 9/2001 Tamura ..... 271/10.03
2002/0096817 A1 * 7/2002 Miki ..... 271/10.11
2002/0101025 A1 * 8/2002 Lee et al. ..... 271/10.11
2003/0193126 A1 * 10/2003 Hoberock ..... 271/10.11
2006/0038338 A1 * 2/2006 Lin ..... 271/10.04

* cited by examiner

*Primary Examiner*—Patrick Mackey
*Assistant Examiner*—Prasad V Gokhale
(74) *Attorney, Agent, or Firm*—Rabin & Berdo, P.C.

(57) ABSTRACT

A document feeder for multifunction printers or scanners offers high reliability and speedy paper-picking, -separating and -feeding functions. It comprises a picking module, a separating module and a feeding module. Since the three modules take turns to deliver paper, the paper can be picked at a lower speed, separated at a medium speed and then fed at a high speed. In addition, the separating module comprises a clutch. When the paper was fed by the feeding module, the clutch is activated to provide an interval between papers and to prevent papers from plucking.

13 Claims, 9 Drawing Sheets

AUTOMATIC DOCUMENT FEEDER

CROSS-REFERENCE TO RELATED APPLICATIONS

This application claims the benefit of Taiwan Patent Application No. 094137959, filed on Oct. 28, 2005, which is hereby incorporated by reference for all purposes as if fully set forth herein.

BACKGROUND OF THE INVENTION

1. Field of Invention

The invention relates to an automatic document feeder used in scanners, copiers, fax machines, or multifunction processors. It is used to separate paper in a pile and to feed it sheet by sheet into a machine for further processing.

2. Related Art

FIG. 1 shows a conventional paper picking/feeding mechanism used in fax machines. It mainly comprises a dynamic gear 11, a paper-picking roller 10, and a paper feeding roller 12. The dynamic gear 11 is directly coupled to rotate the paper feeding roller 12. A clutch (not shown) comprised of a spring is inserted between the dynamic gear 11 and the paper-picking roller 10. The speed of the paper feeding roller 12 is designed to be greater than that of the paper-picking roller 10. When this mechanism is in action, the dynamic gear 11 drives the paper-picking roller 10 (the clutch is closed at this moment), so that the paper 13 is pulled by the paper-picking roller 10 and sent to the paper feeding roller 12. Since the paper feeding roller 12 has a higher speed than the paper-picking roller 10, the paper 13 drives the paper-picking roller 10 to reach a higher rotating speed than the dynamic gear 11. The clutch is thus in the open state without pulling the paper 13. The above-mentioned conventional structure can be seen in U.S. Pat. No. 5,630,580, "FEED ROLL ASSEMBLY ADAPTED FOR DELIVERING SHEET OF clutch still produces a pulling force on the paper 13 even when the clutching gap is insufficient. This is disturbing for the operations of processors.

U.S. Pat. No. 6,024,357, "DOCUMENT SHEET FEEDING MECHANISM" discloses a mechanical clutch and paper separating design. Its primary goal is to solve the problems of separating and pulling paper. It uses a mechanical clutch and an appropriate gap design so that the paper is not pulled in this case. With the paper separating design, there is a higher reliability in picking a single sheet of paper. Even so, the paper separating design and the paper-picking roller are disposed at the same position. Therefore, the paper separating effect is still not reliable in practice. Therefore, U.S. Pat. No. 6,540,220, "PAPER FEEDING SYSTEM WITH BOTH PAPER ENGAGING AND PAPER SEPARATING MECHANISMS" proposed an automatic document feeder. It uses a swing-arm paper-picking roller to touch and move the paper to the paper-separating roller. The paper-separating roller is provided with a friction board. When the paper-picking roller picks more than one sheet of paper and feeds them to the paper-separating roller, only the sheet that is in contact with the paper-separating roller is passed on while the sheet in contact with the friction board is left behind because the friction of the friction board is greater than the paper-separating roller. To prevent paper from pulling after entering the paper-separating roller or overfeeding, the swing arm is controlled by a motor to increase/decrease its speed or even reverse its rotating direction. Therefore, the paper-picking roller is lifted without contacting the paper, providing a gap between two sheets of paper.

Even though the above-mentioned proposals have the paper picking/separating functions, paper pulling still happens. Moreover, current processors often need to process recycled paper. Such paper makes the paper picking/separating even more difficult.

SUMMARY OF THE INVENTION

In view of the foregoing, the paper picking/separating mechanisms in the prior art is not reliable enough for recycled paper. Secondly, there is a higher demand for faster processing speeds of the processors. In this case, the traditional designs often feed in more than one sheet of paper or have paper jams. Therefore, the invention provides an automatic document feeder to provide paper-picking, -separating, and -feeding functions with even higher speeds and reliability.

According to an embodiment of the invention, the automatic document feeder includes a paper-picking roller coupled to a paper-picking arm, a paper-separating roller coupled to the paper-picking arm, a driving shaft coupled to the paper-separating roller, and a paper-feeding roller. The speed of the paper-feeding roller is designed to be higher than that of the paper-separating roller, and the speed of the paper-separating roller is higher than that of the paper-picking roller. A clutch is provided between the driving shaft and the paper-separating roller. Therefore, paper is transferred from the paper-picking roller via the paper-separating roller to the paper-feeding roller. When paper reaches the paper-feeding roller, the paper-separating roller and the driving shaft are separated due to the clutch and the high speed of the roller. Therefore, the speeds of the paper-separating roller and the paper-feeding roller are the same, without pulling the paper. When the paper is moved out of the paper-separating roller, the clutch is still in the separate state. The driving shaft is not coupled to the paper-separating roller. In this case, both the paper-separating roller and the paper-feeding roller are not in action. That is, no paper is processed until the driving shaft catches up the gap of the clutch.

The invention uses the paper-picking roller to pick paper at a low speed, the paper-separating roller to separate paper at a medium speed, and the paper-feeding roller to feed paper at a high speed. The invention achieves three goals. Firstly, the speeds of the paper-feeding roller and the paper-picking roller do not need to be adjusted or reversed in direction. The speeds can be increased step by step. Therefore, the difference between the two speeds can be a factor of 2.5 or more. Secondly, the paper-picking roller and the paper-separating roller are designed to be separate, so that the reliability of separating paper is greatly enhanced. The invention can ensure that no more than one sheet of paper is being sent even when recycled paper is used. Thirdly, once the previous sheet of paper is sent out of the paper-separating roller, the paper-separating roller is immediately not in action until the driving shaft catches up with the gap of the clutch. Only after that can the driving shaft couples to the paper-picking roller to pick paper. This produces a gap between two consecutive sheets of paper. This also enables the process to count the sheets.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

The automatic document feeder disclosed herein can be applied to multifunction processors (MFP), fax machines, copiers, and scanners. In the following description, we use the applications in scanners and MFP's as our preferred embodiments.

Figure 1:
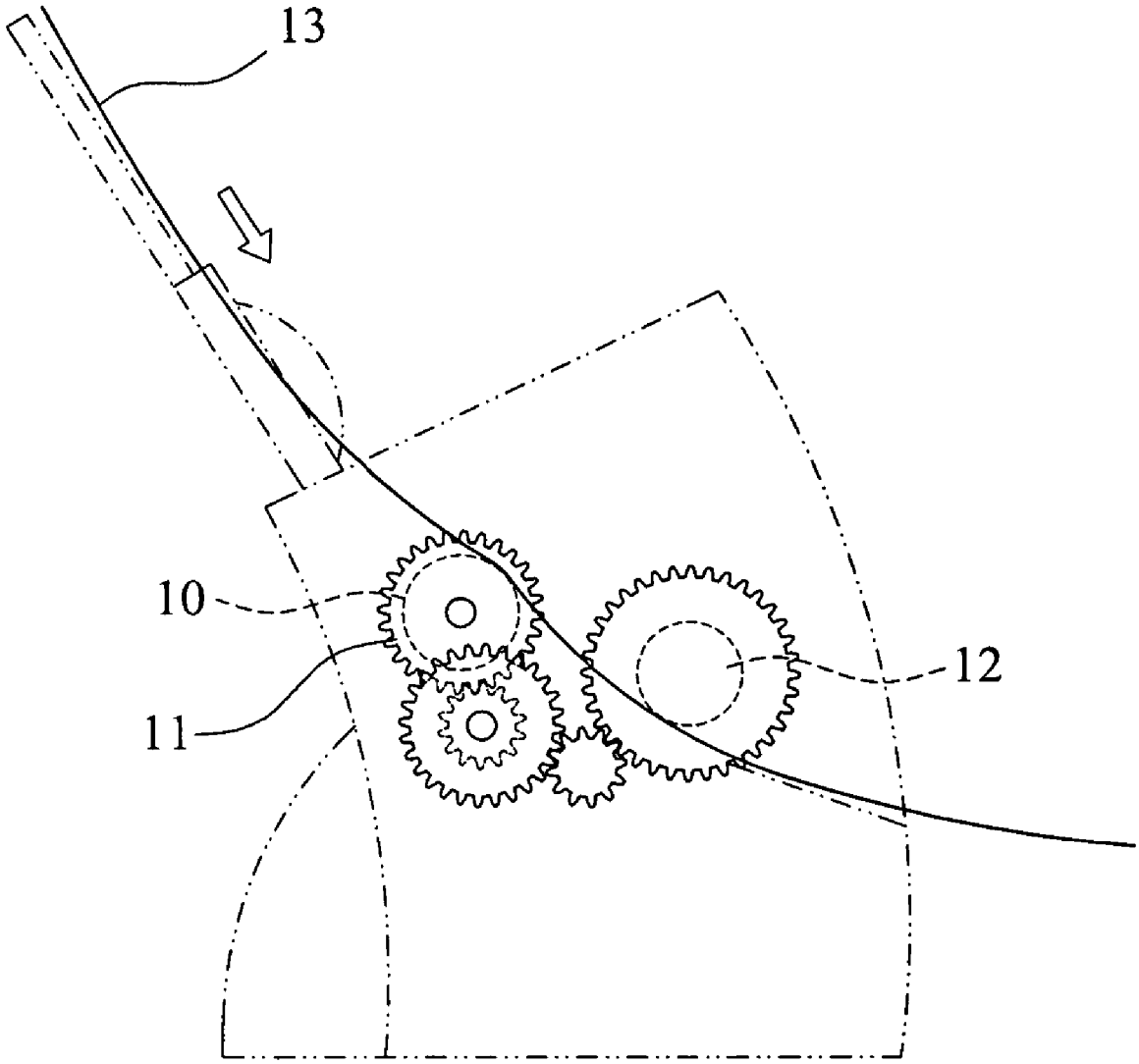
FIG.1 (PRIOR ART)
FIG. 1 is a schematic view of the prior art.
Figure 2:
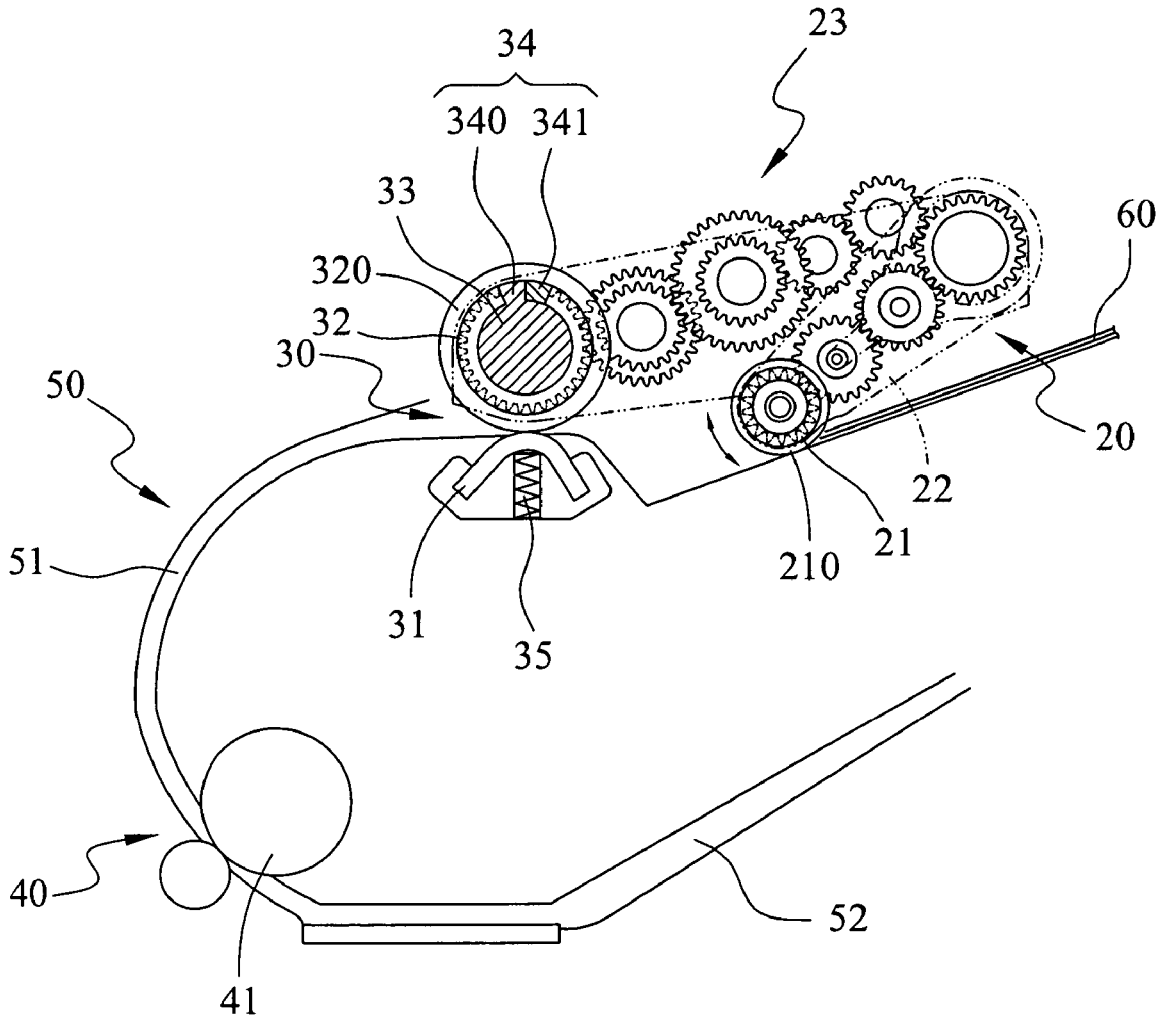
FIG. 2 is a schematic view showing the structure of the invention.

With reference to FIG. 2, the invention includes a paper-picking module 20, a paper-separating module 30, a paper-feeding module 40, and a shell 50. The paper 60 is transferred in sequence through a paper-transferring track 51 composed of the paper-picking module 20, the paper-separating module 30, and the shell 50, and the paper-feeding module to reach the entrance 52 for the next process.

The paper-picking module 20 includes a paper-picking roller 21 disposed at one end of a paper-picking arm 22. When the paper-picking module 20 functions, the arm 22 swings up and downs according to the thickness of each sheet of paper 60 in order to properly transfer a sheet of paper to the next stage. Since the outer surface of the paper-picking roller 21 is provided with a friction board 210 with a larger friction, the top sheet of paper 60 is moved out to the left of the drawing when the paper-picking roller 21 is in touch with the paper 60. This is because the friction between each two sheets of paper is smaller than that between the friction board 210 and the top sheet of paper 60.

Figure 3:
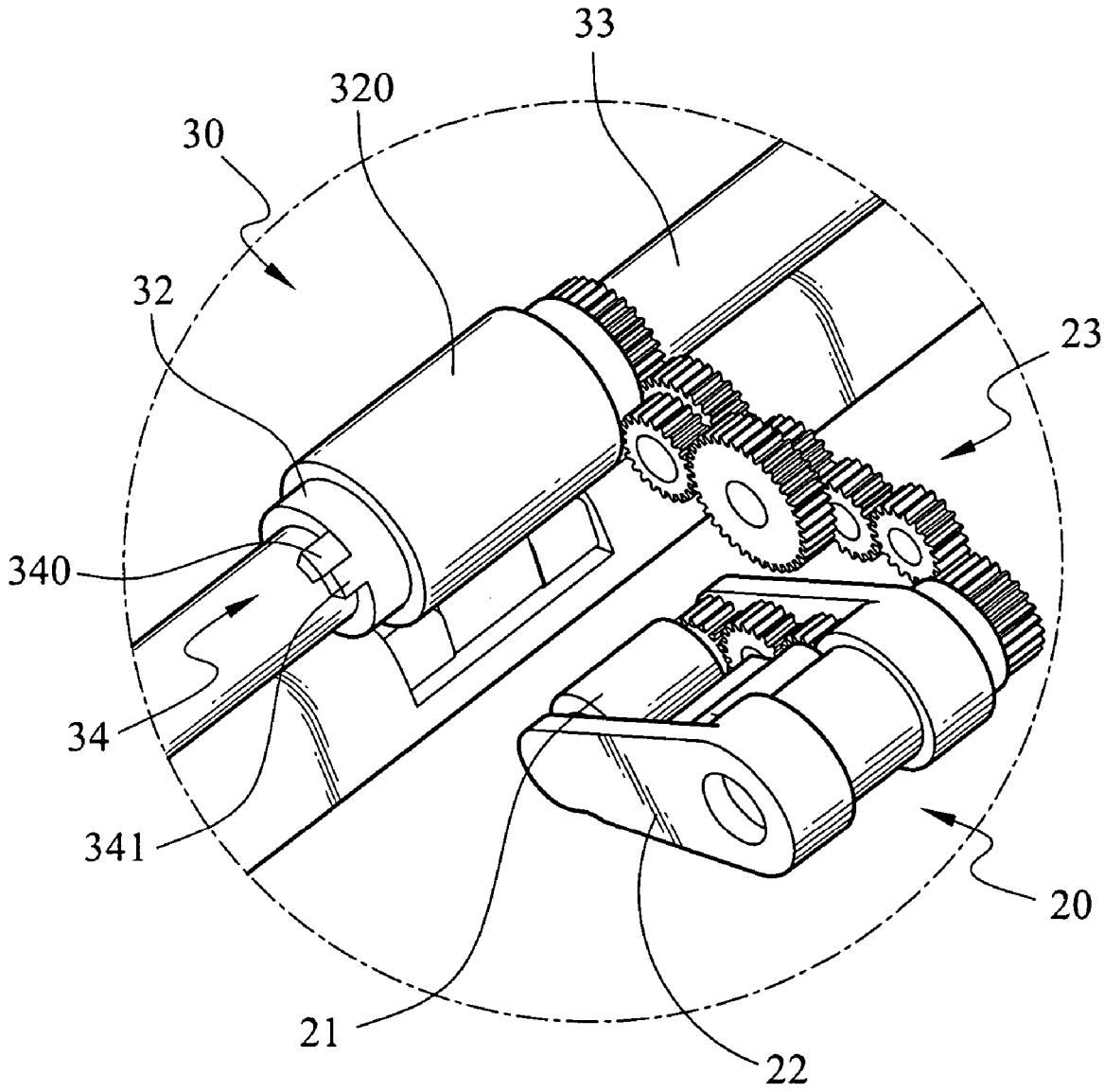
FIG. 3 is a perspective view of the disclosed clutch.
Figure 4:
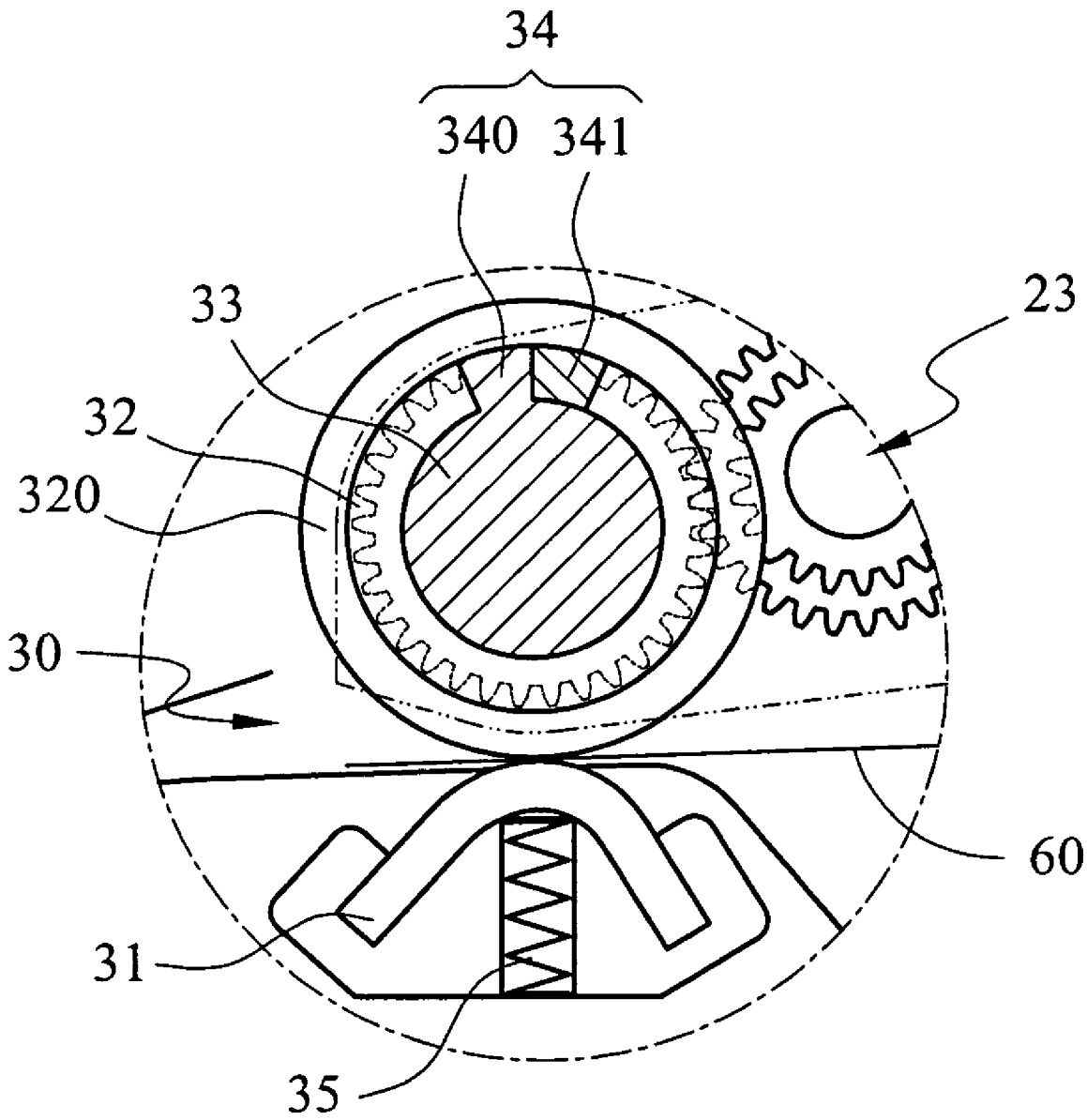
FIG. 4 is a schematic view showing the structure of the paper-separating roller and the damping element in the invention.
Figure 7:
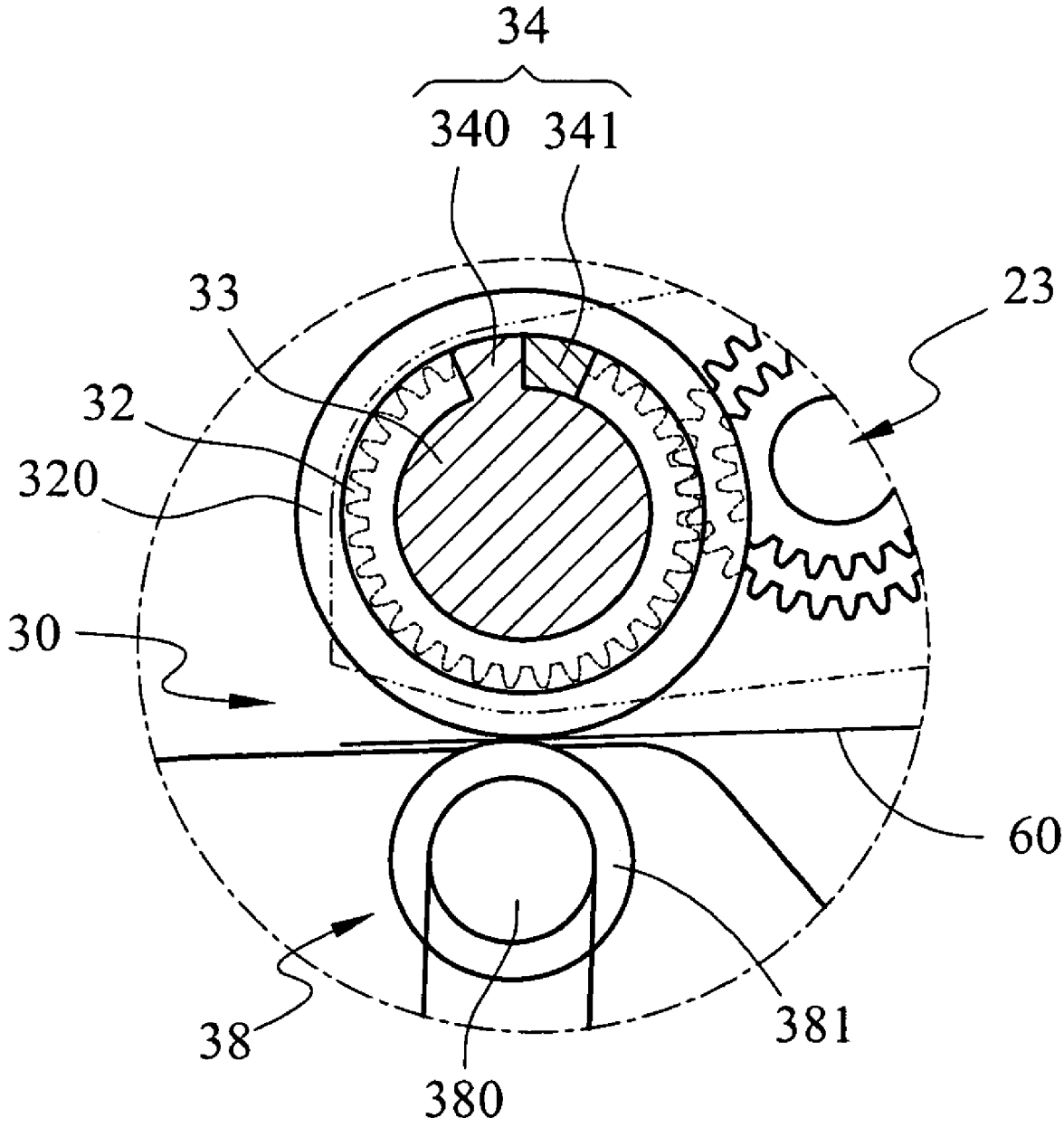
FIG. 7 shows another embodiment of the disclosed damping element.

With simultaneous reference to FIGS. 2 and 3, the paper-separating module 30 includes a damping element 31, a paper-separating roller 32 in contact with the damping element 31, a driving shaft 33, and a clutch for coupling the driving shaft 33 and the paper-separating roller 32. The clutch 34 is comprised of a first clutch element 340 fixed on the driving shaft 33 and a second clutch element 341 fixed on the paper-separating roller 32. The first clutch element comprises a first tooth that projects in a radial direction from a surface of the driving shaft. The second clutch element comprises a second tooth that projects in an axial direction from an end of the paper-separating roller. When the first tooth abuts against the second tooth, the clutch is closed, and when the first tooth is separated from the second tooth, the clutch is separate. Apart from fixed installation of the clutch elements 340, 341, they can be formed from extensions of the paper-separating roller 32 and the driving shaft 33. The surface of the paper-separating roller 32 is disposed with a friction board 320 with a larger frictional coefficient than the paper. The frictional coefficient of the damping element 31 is designed to be smaller than that of the friction board 320, but larger than that of the paper. Therefore, as shown in FIG. 4, when more than one sheet of paper is transferred to the paper separating module 30, this design of frictional coefficients allows only the sheet 60 in contact with the paper-separating roller 32 to move on to the next step, the rest 60 remains at the damping element 31. In this embodiment, the damping element 31 is designed as a board type element. However, the damping element 31 can be designed as a roller type element having the same function as the damping element 31. Please refer to FIG. 7. It shows another embodiment of the damping element 31, which is a damping roller 38 in constant contact with the paper-separating roller 32. The damping roller comprises a torque limit roller 380 and a friction cover 381 fixed on the surface of the torque limit roller 380. The torque limit roller 380 provides a continuous force to keep the friction cover 381 in constant contact with the paper-separating roller 32.

The disposition of the first and second clutch elements 340, 341 is such that when the rotating speed of the paper-separating roller 32 is slower than that of the driving shaft 33, the driving shaft 33 can rotate the paper-separating roller 32. When the rotating speed of the paper-separating roller 32 is higher than that of the driving shaft 33, the clutch elements 340, 341 depart so that the driving shaft 33 does not rotate the paper-separating roller 32. Moreover, with reference to FIG. 4, the paper-separating roller 32 is coupled to the paper-picking roller 21 via a decelerating mechanism 23. At the same time, the linear speed of the paper-separating roller 32 is designed to be higher than that of the paper-picking roller 21. Therefore, when the paper 60 enters the paper-separating roller 32, it proceeds with a larger linear speed. This design primarily slows down the paper-picking speed as much as possible. Therefore, not more than one sheet of paper is retrieved at a time. When the paper enters the paper-separating roller 32, its speed can be increased to speed up its operation.

Figure 5A:
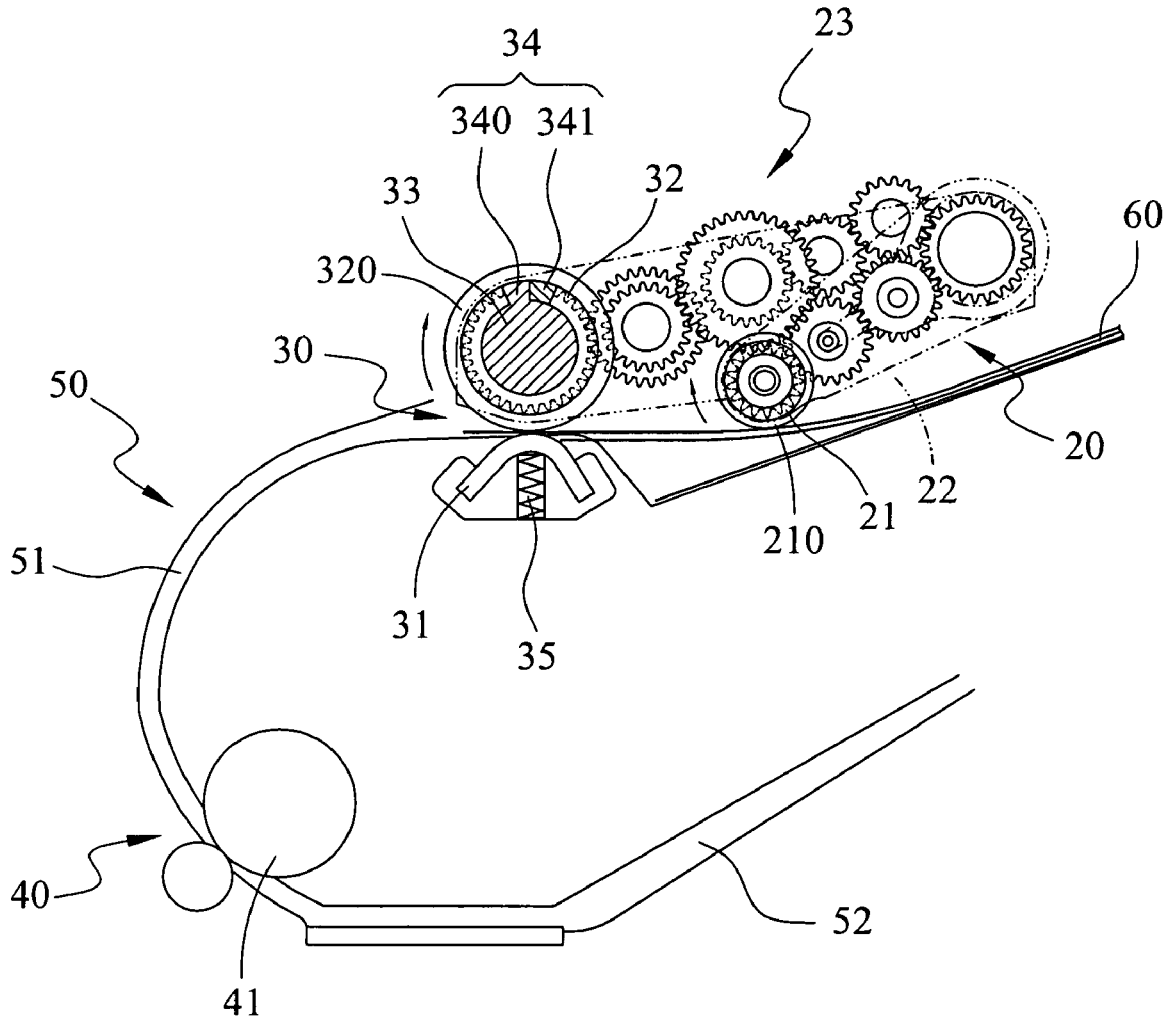
FIGS. 5A to 5C are schematic views showing the action of the clutch according to the invention.
Figure 5B:
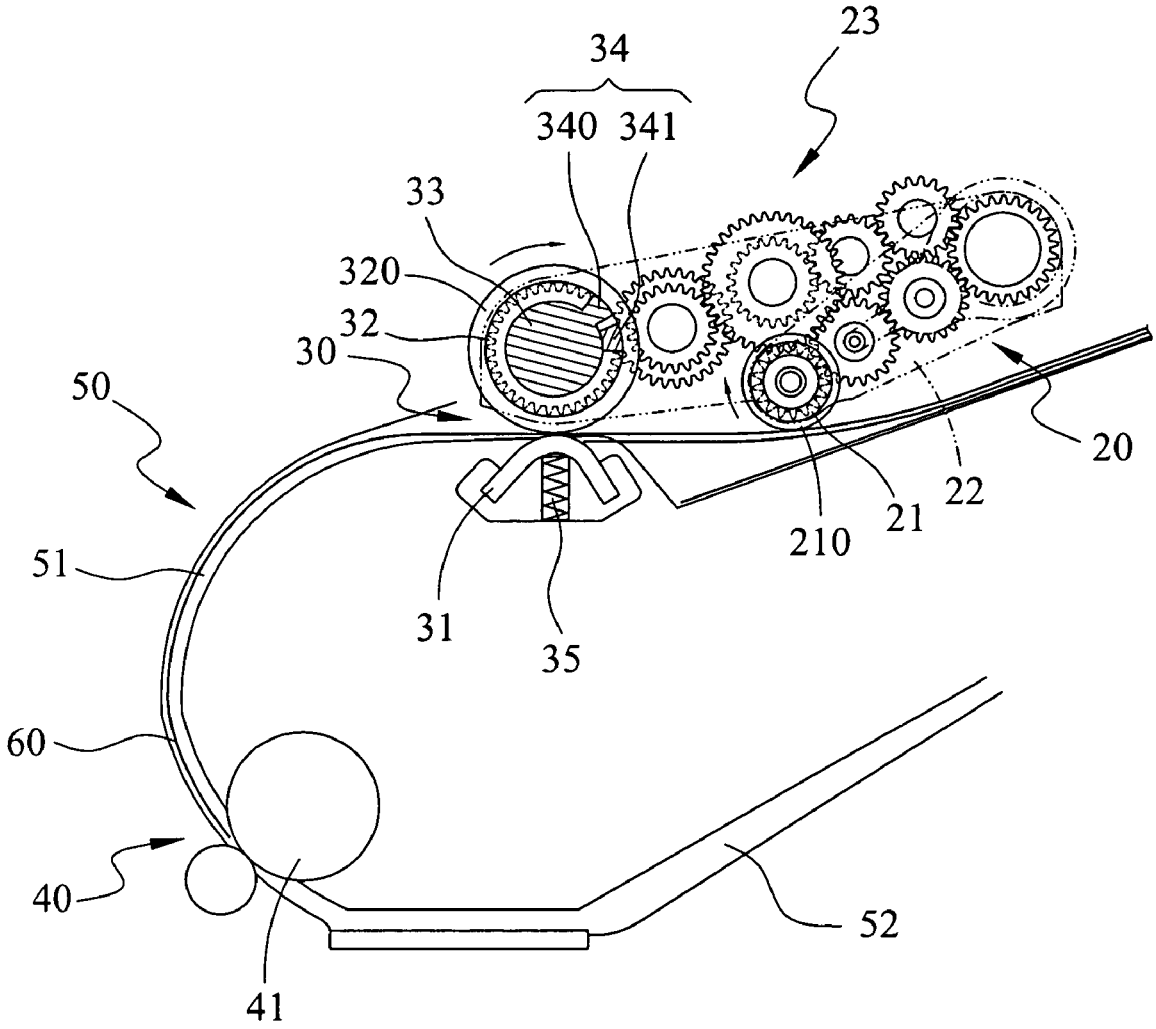
Figure 5C:
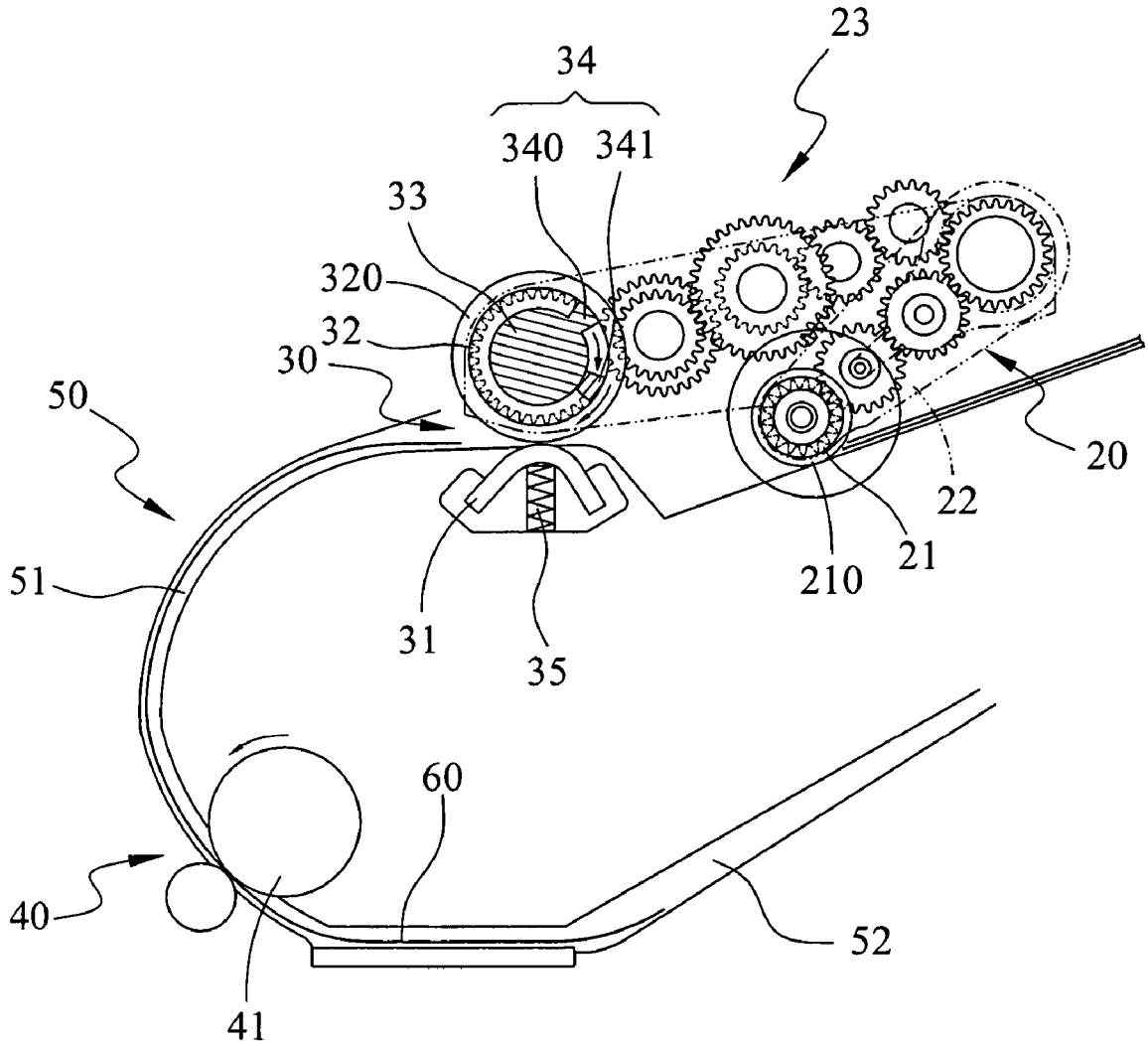

The paper-feeding module 40 has a paper-feeding roller 41 driven by an independent motor (not shown) and designed to have a linear speed larger than the paper-separating roller 32. Therefore, when the paper 60 reaches the paper-feeding roller 41, its speed is further increased. Driven via the paper 60, the speed of the paper-separating roller 32 becomes the same as the paper-feeding roller 41 (the clutch 34 is separate). This action is illustrated in FIGS. 5A to 5C. FIG. 5A shows that when more than one sheet of paper 60 is sent to the paper-separating roller 32, the action of the paper-separating roller 32 and the damping element 31 separate the paper 60, allowing only one sheet 60 to be transferred into the paper-transferring track 51. In this case, the paper-separating roller 32 is driven by the driving shaft 33. The clutch 34 is closed, as shown in FIG. 5A. Secondly, as shown in FIG. 5B, when the paper 60 is transferred to the paper-feeding roller 41, the linear speed of the paper-separating roller 32 is increased to be the same as the paper-feeding roller 41. Therefore, the transferring speed of the paper 60 increases without pulling the sheets. The clutch 34 at this moment is separate. As shown in FIG. 5C, when the rear end of the sheet 60 is transferred out of the paper-separating roller 32, the paper-separating roller 32 is not active because the clutch 34 is still separate and the paper-separating roller 32 is in contact with the damping element 31. Since the driving shaft 33 is continuous working, the gap between the first and second clutch elements 340, 341 reduces. When the first and second clutch elements 340, 341 are closed, the driving shaft 33 starts to rotate the paper-separating roller 32 again. That is, the paper-picking roller 21 is driven to pick paper again. In this case, a gap is formed between the next sheet and the previous sheet for the convenience of counting and checking.

Figure 6:
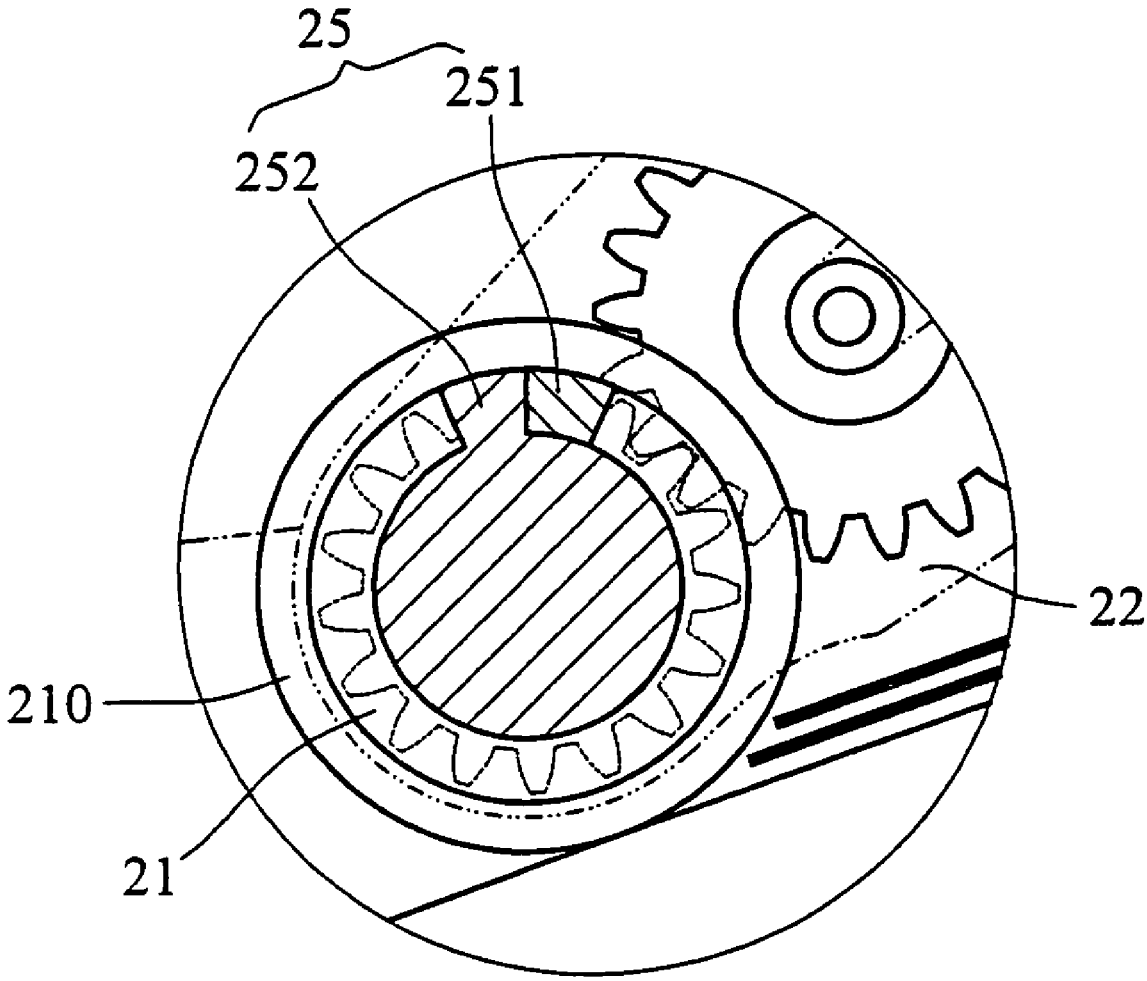
FIG. 6 shows another embodiment of the disclosed paper-picking roller.

Moreover, when the paper 60 reaches the paper-feeding roller 41, the speed of the paper-separating roller 32 becomes the same as the paper-feeding roller 41. However, since the paper-picking roller 21 is driven by the paper-separating roller 32 at the moment, some pilling still exists. To prevent this phenomenon, another clutch 25 can be disposed between the paper-picking arm 22 and the paper-picking roller 21 (as shown in FIG. 6). The first clutch element 251 is fixed on the paper-picking roller 21, and the second clutch element 252 is directly driven by the decelerating mechanism 23 of the paper-picking arm.22, so that the linear speed of the paper-picking roller 21 becomes the same as the paper-separating roller 32. This gives another embodiment of the invention.

To enhance the reliability of the invention, a spring 35 is provided below the damping element 31 (see FIG. 2) to have continuous contact with the paper-separating roller 32. Alternatively, one may select a rubber material for the damping element 31 and bend it to have continuous contact with the paper-separating roller 32.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An automatic document feeder for separating preloaded sheets of paper and transferring them to another side, comprising:

a paper-picking roller, which rotates to move one of the sheets of paper;

a paper-separating roller, which is coupled via a gear set with the paper-picking roller to rotate the paper-picking roller and receives the sheet of paper transferred from the paper-picking roller;

a damping element, which is in constant contact at a contact position with the paper-separating roller, the contact position being the position for the paper-separating roller to receive the sheet of paper;

a driving shaft, which provides a rotating force;

a clutch, which comprises a first clutch element fixed on the driving shaft and a second clutch element fixed on the paper-separating roller, wherein the driving shaft rotates the paper-separating roller when the clutch is closed and does not rotate the paper-separating roller when the clutch is separate, wherein the first clutch element comprises a first tooth that projects in a radial direction from a surface of the driving shaft, and the second clutch element comprises a second tooth that projects in an axial direction from an end of the paper-separating roller, and wherein when the first tooth abuts against the second tooth, the clutch is closed, and when the first tooth is separated from the second tooth, the clutch is separate; and a paper-feeding roller, which receives and transfers the sheet of paper transferred from the paper-separating roller;

wherein when the clutch is closed, a linear speed of the paper-feeding roller is larger than that of the paper-separating roller, and when the sheet of paper is transferred simultaneously by the paper-separating roller and the paper-feeding roller, the clutch is separate so that the paper-feeding roller and the paper-separating roller have the same linear speed.

2. The automatic document feeder of claim 1, wherein the frictional coefficient between the paper and either of the paper-separating roller and the paper-picking roller is greater than the frictional coefficient between two sheets of the paper.

3. The automatic document feeder of claim 1, wherein the paper-separating roller is mounted with a friction board, with a frictional coefficient between the friction board and the paper being greater than that between two sheets of the paper.

4. The automatic document feeder of claim 1, wherein the paper-picking roller is mounted with a friction board, with a frictional coefficient between the friction board and the paper being greater than that between two sheets of the paper.

5. The automatic document feeder of claim 1, wherein the frictional coefficient between the paper and the damping element is smaller than that between the paper and the paper-separating roller and larger than that between two sheets of the paper.

6. The automatic document feeder of claim 1, wherein the paper-picking roller and the paper-separating roller is coupled via a clutch so that when the clutch is closed, the paper-picking roller is directly rotated by the paper-separating roller, and when the clutch is separate, the paper-picking roller is not rotated by the paper-separating roller.

7. The automatic document feeder of claim 6, wherein the paper-separating roller is mounted with a friction board, with a frictional coefficient between the paper and the friction board being larger than the frictional coefficient between two sheets of the paper.

8. The automatic document feeder of claim 6, wherein the paper-picking roller is mounted with a friction board, with a frictional coefficient between the paper and the friction board being greater than the frictional coefficient between two sheets of the paper.

9. The automatic document feeder of claim 1, wherein the paper-separating roller drives the paper-picking roller via a decelerating gear so that the linear speed of the paper-separating roller is greater than that of the paper-picking roller.

10. The automatic document feeder of claim 9, wherein the decelerating gear has a clutch so that when the clutch is closed, the paper-separating roller directly drives the paper-picking roller, and when the clutch is separate, the paper-picking roller is not driven by the paper-separating roller.

11. The automatic document feeder of claim 1, wherein the damping element has a spring for the damping element to be in continuous contact with the paper-separating roller.

12. The automatic document feeder of claim 1, wherein the damping element is a board type element.

13. The automatic document feeder of claim 1, wherein the damping element is a damping roller, the damping roller comprising a torque limit roller and a friction cover fixed on the torque limit roller.

* * * * *